US008777451B2

(12) United States Patent
Martinez

(10) Patent No.: US 8,777,451 B2
(45) Date of Patent: Jul. 15, 2014

(54) DEVICE FOR UNIFORM, LARGE AREA FLOOD EXPOSURE WITH LEDS

(75) Inventor: Aaron D. Martinez, Arvada, CO (US)

(73) Assignee: Air Motion Systems, Inc., River Falls, WI (US)

( * ) Notice: Subject to any disclaimer, the term of this patent is extended or adjusted under 35 U.S.C. 154(b) by 209 days.

(21) Appl. No.: 13/276,433

(22) Filed: Oct. 19, 2011

(65) Prior Publication Data

US 2012/0099320 A1 Apr. 26, 2012

Related U.S. Application Data

(60) Provisional application No. 61/394,888, filed on Oct. 20, 2010.

(51) Int. Cl.
*F21V 29/00* (2006.01)
*F21V 21/00* (2006.01)

(52) U.S. Cl.
USPC ..... 362/249.02; 362/33; 362/294; 362/373; 362/573

(58) Field of Classification Search
USPC ..... 362/33, 249.02, 294, 373, 573
See application file for complete search history.

(56) References Cited

U.S. PATENT DOCUMENTS

| | | | | |
|---|---|---|---|---|
| 6,457,846 | B2 * | 10/2002 | Cook et al. | 362/321 |
| 6,619,819 | B2 * | 9/2003 | Stowell et al. | 362/294 |
| 7,267,456 | B1 * | 9/2007 | Holmes | 362/276 |
| 7,488,102 | B2 * | 2/2009 | Brukilacchio | 362/573 |
| 2006/0139935 | A1 | 6/2006 | Huang | |
| 2007/0189018 | A1 * | 8/2007 | Tausch et al. | 362/346 |
| 2008/0025013 | A1 * | 1/2008 | Lockamy et al. | 362/33 |
| 2008/0062694 | A1 * | 3/2008 | Lai et al. | 362/294 |
| 2009/0046457 | A1 | 2/2009 | Everhart | |
| 2010/0220472 | A1 * | 9/2010 | Dahm | 362/231 |

OTHER PUBLICATIONS

Apr. 18, 2012 International Search Report for corresponding PCT application PCT/US2011/056814 with reasoned statement.

* cited by examiner

*Primary Examiner* — Stephen F Husar
*Assistant Examiner* — James Cranson, Jr.
(74) *Attorney, Agent, or Firm* — Wm. Larry Alexander Attorney at Law, P.A.

(57) ABSTRACT

A method for providing uniform flood exposure of LED light onto large area substrates is disclosed herein. The substrates can be up to several square meters in surface area. A method for providing uniform cooling of the LEDs within the apparatus is also disclosed.

16 Claims, 13 Drawing Sheets

DEVICE FOR UNIFORM, LARGE AREA FLOOD EXPOSURE WITH LEDS

CROSS-REFERENCES TO RELATED APPLICATIONS

This application claims priority under 35 U.S.C. §119 (e) to, and hereby incorporates by reference, U.S. Provisional Application No. 61/394,888, filed 20 Oct. 2010.

BACKGROUND OF THE INVENTION

1. Field of the Invention

This invention relates to substrate printing and, in particular, this invention relates to a device for curing ink being printed on a substrate.

2. Background

LEDs offer a potentially more efficient means of curing ink deposited on a substrate during a printing operation. This enhanced efficiency includes lower power requirement and less heat produced during use. However, the geometries of illumination emitted from LEDs needs to be sufficiently uniform to ensure that the ink being printed upon the substrate is sufficiently cured, especially over substrates having large surface areas. To the best of the inventor's knowledge, there has been no device to provide such uniform illumination on such a substrate being cured during a printing operation.

There is then a need for a device to provide such uniform illumination on a substrate being cured during a printing operation. There is a particular need for such a device which could provide specific levels of uniformity of illumination.

SUMMARY OF THE INVENTION

This invention substantially meets the aforementioned needs of the industry by providing a device for illuminating a substrate with LEDs, the device having a first plurality of first LEDs positioned in a first LED array such that said substrate is illuminated substantially uniformly by said first LEDs; means for providing electrical current to said LEDs; and means for cooling said LEDs.

Also present in such device may be a second plurality of second LEDs positioned in a second LED array such that said substrate is illuminated substantially uniformly by said second LEDs.

The illumination emitted from the present first or second LED array may vary less than about 5%, 2.5%, or 1% over the substrate.

Further provided is a method for uniformly illuminating a substrate, comprising emitting illumination toward said substrate from a first LED array, said first LED array including a first plurality of LEDs positioned such that illumination emitted from said first LED array varies less than about 5% over the surface of said substrate.

The foregoing method may further include emitting illumination toward said substrate from a second array, said second LED array including a second plurality of LEDs position such that illumination emitted from said second LED array varies less than about 5% over the surface of said substrate.

Yet further provided is a method of manufacturing a device for illuminating a substrate being printed upon, comprising positioning a first plurality of first LEDs such that said illumination emitted from said first LEDs varies less than about 5%.

The foregoing method may also include positioning a second plurality of second LEDs such that said illumination emitted from said second LEDs varies less than about 5%.

The foregoing method may further include positioning a heat sink in contacting relation to each first and second LED.

It is understood that the above-described figures are only illustrative of the present invention and are not contemplated to limit the scope thereof.

DESCRIPTION

Figure 1:
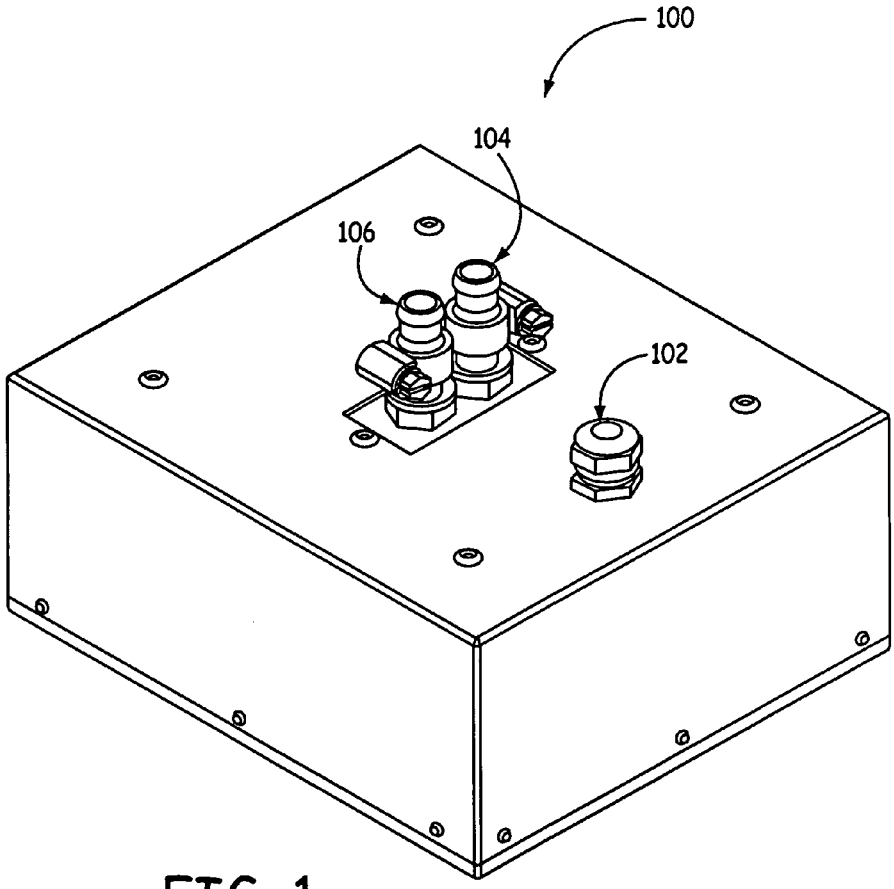
FIG. 1 is a perspective view of one embodiment of a lamp employing a dimensional LED array of this invention.
Figure 2:
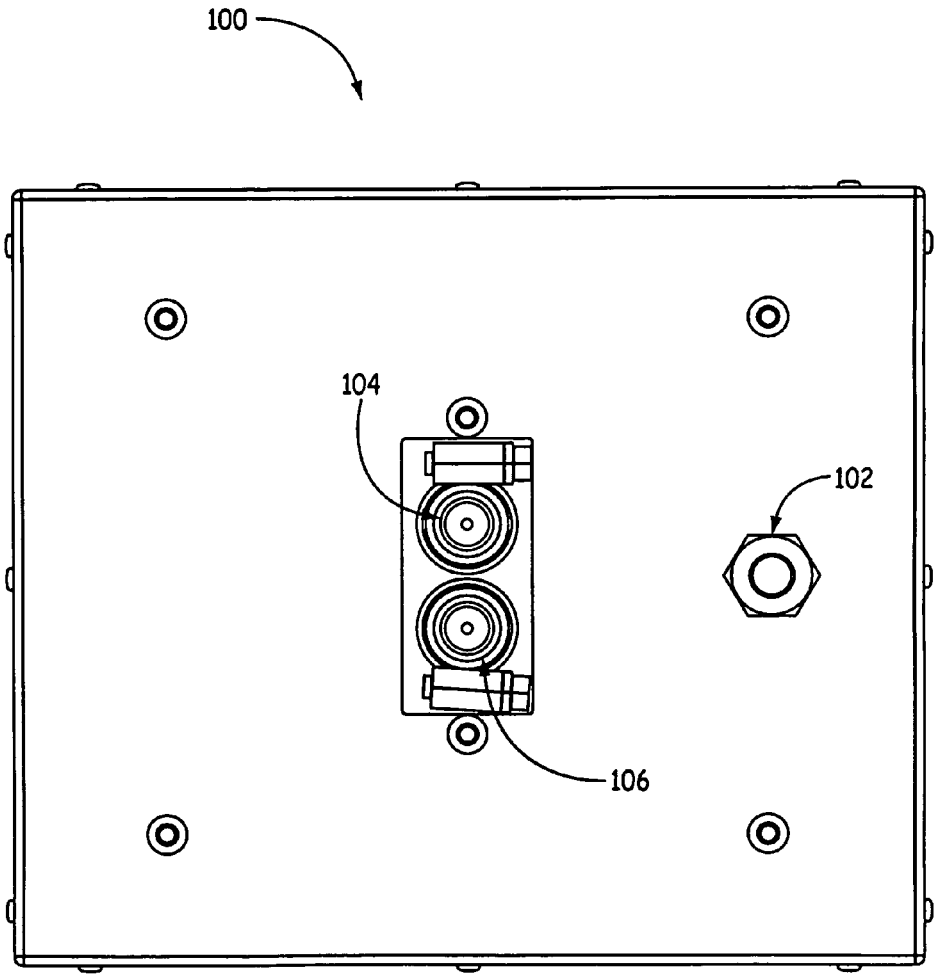
FIG. 2 is a top view of the lamp of FIG. 1.
Figure 3:
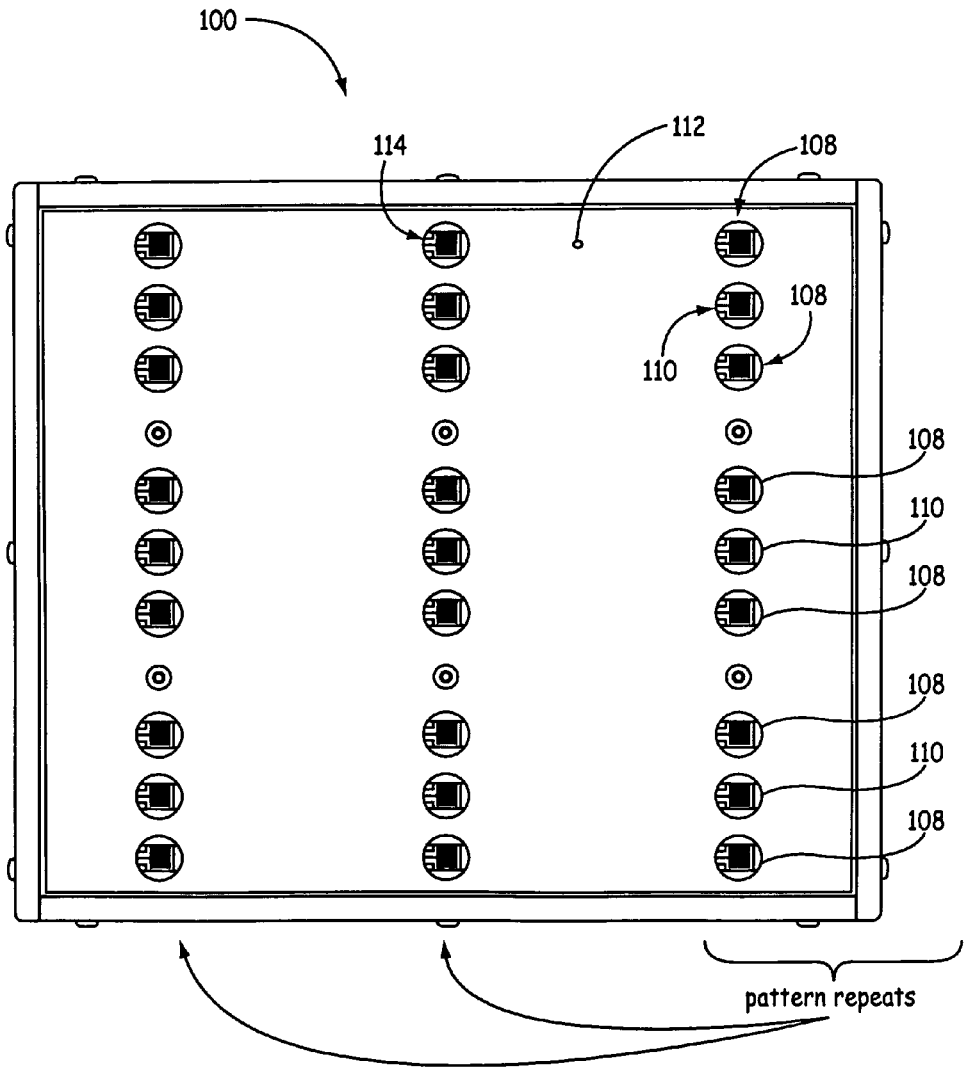
FIG. 3 is bottom view of the lamp of FIG. 1.

While other embodiments of the invention are possible, the following description should be understood to be an explanation of the principles of this invention. Consequently, the following description does not limit this invention to the embodiments described, but merely teaches one aspect of this invention. To achieve uniform, flood type irradiation of a substrate, a lamp head is provided that contains a two dimensional, N×M array of LEDs. The LEDs emit light out the base of the lamp head 100 shown in FIG. 1. FIG. 1 shows the lamp head 100, the electrical port 102 for providing power to the LEDs and the coolant ports 104, 106 that provide liquid coolant maintain the desired low junction temperature of the LEDs. FIG. 2 is a top view of the lamp head. FIG. 3 is a bottom view of the lamp head.

The bottom view of FIG. 3 shows the side of the lamp head from where the light is emitted. The LEDs 108, 110 can be seen. The LEDs 108, 110 are positioned in a rectangular N×M array. The array is covered with a flat reflective cover 112 with holes 114 cut into it to allow the light from the LEDs 108, 110 to shine through. The array and reflective cover 112 are also covered with a transparent material such as glass or quartz which is not shown in FIG. 3.

Figure 4:
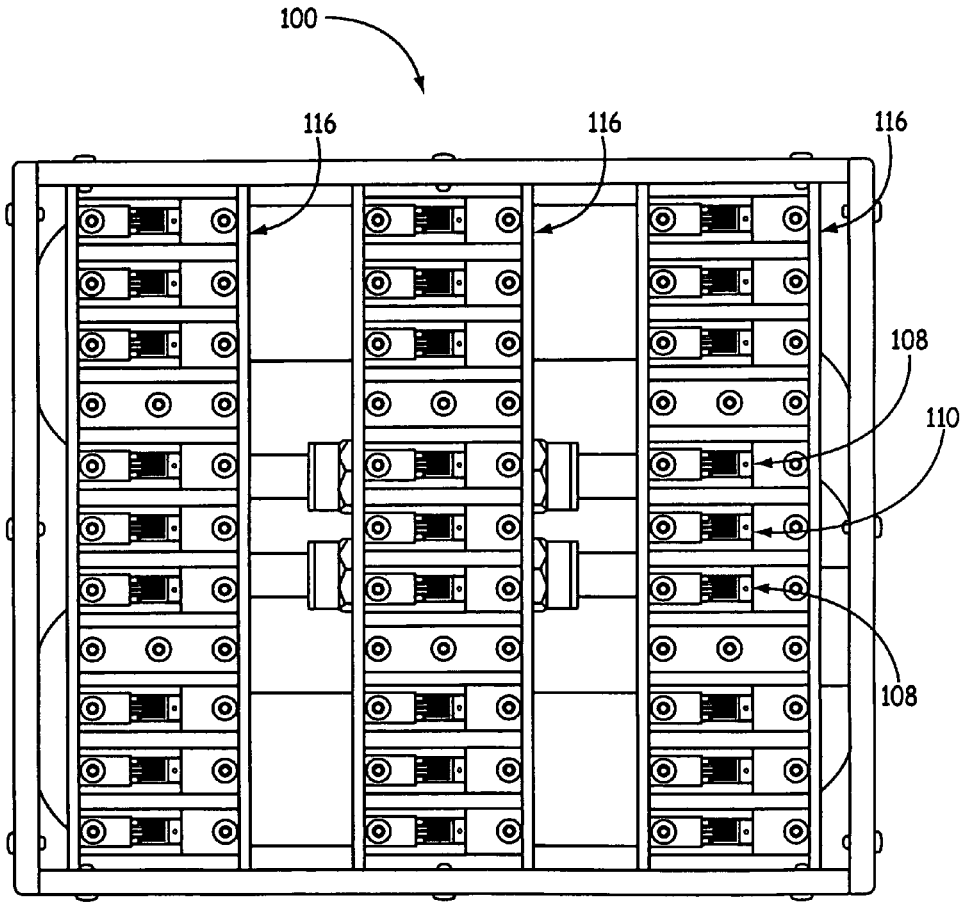
FIG. 4 is a bottom view of the lamp of FIG. 1 with the reflective cover removed.

FIG. 4 shows the bottom view with the reflective cover 112 removed. In FIG. 4 the water cooled heat sinks 116 can be seen.

Figure 5:
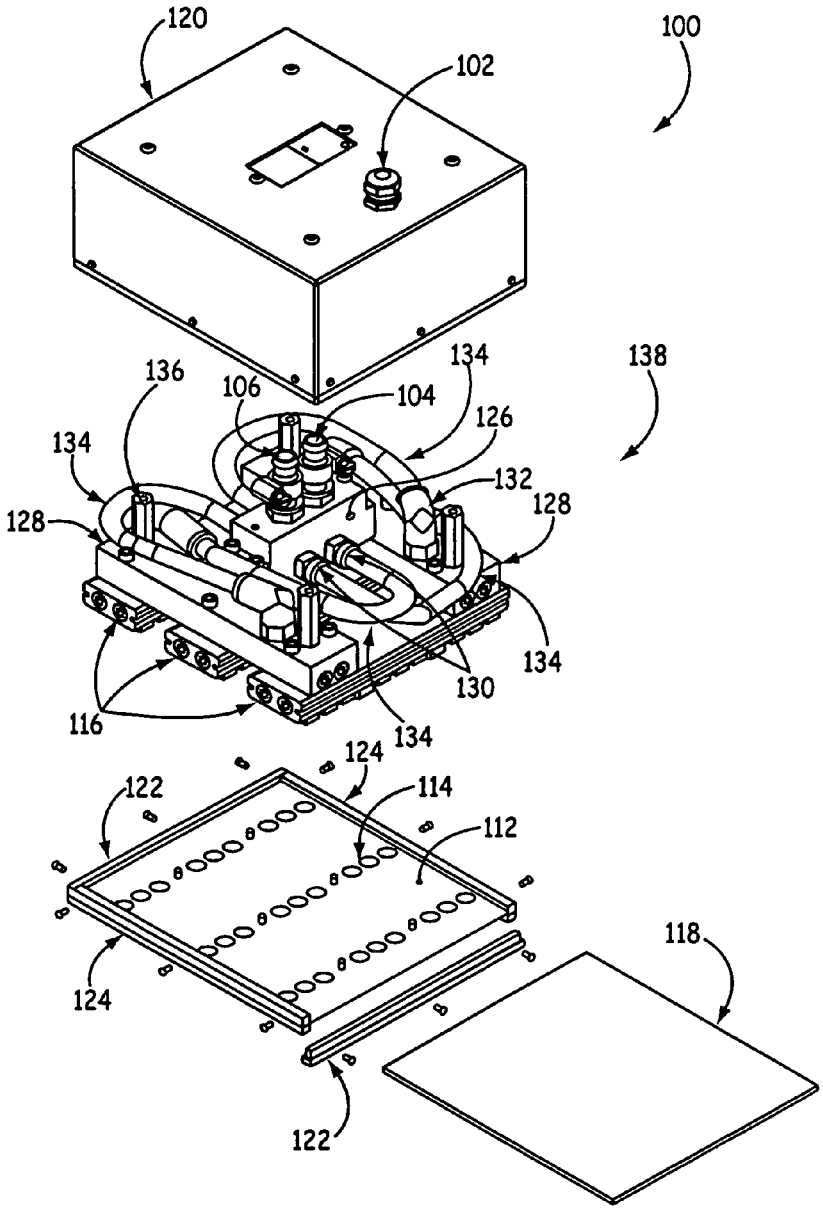
FIG. 5 is an exploded view of the lamp of FIG. 1.

FIG. 5 shows an exploded view of the lamp head 100. FIG. 5 shows the transparent cover 118 and the reflective cover 112. It shows the frame pieces 122, 124 that hold the transparent cover 118 onto the housing 120. FIG. 5 shows the coolant tee block 126 and the distribution manifolds 128. FIG. 5 shows coolant fittings 130, 132 and tubing 134. FIG. 5 shows stand-offs 136 that may be used to mount the cooling assembly 138 into the housing 120.

Figure 6:
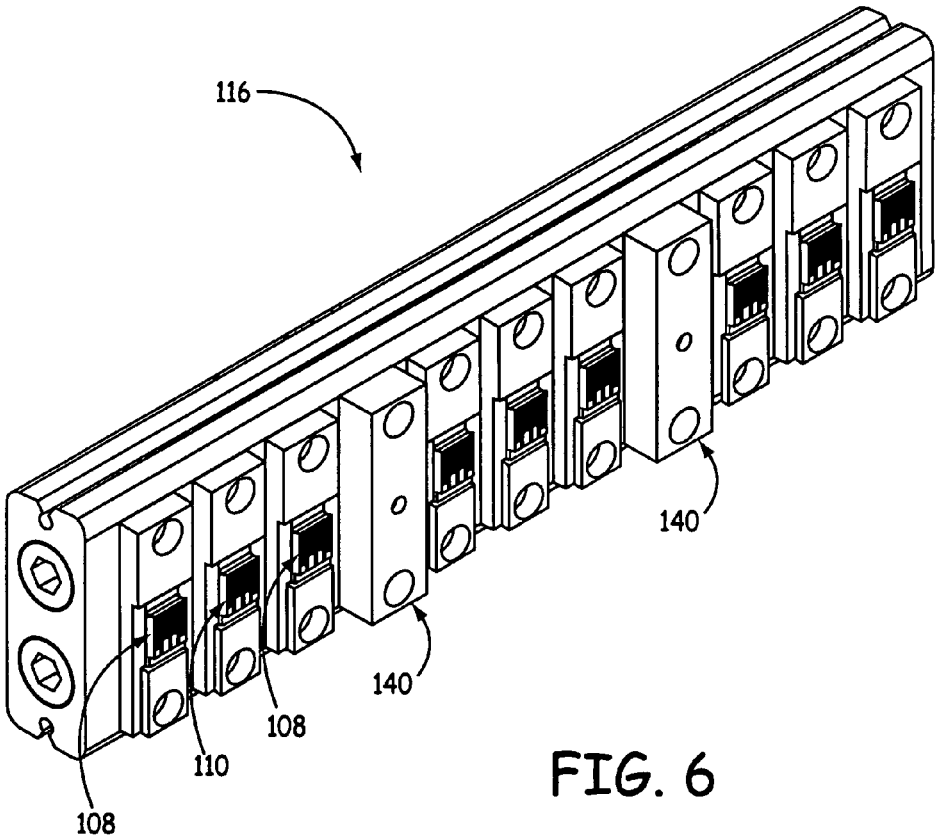
FIG. 6 is an isometric view of a water cooled heat sink suitable for use in this invention with LEDs mounted thereto.
Figure 7:
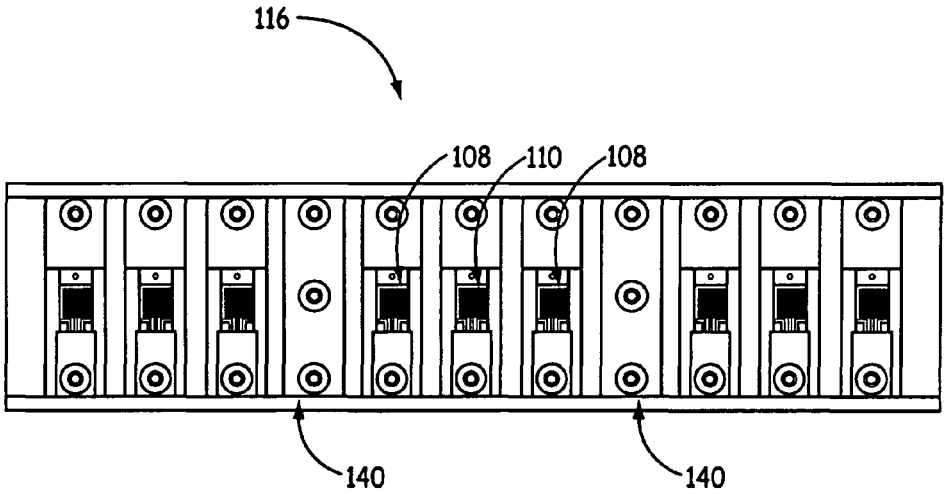
FIG. 7 is a top view of the water cooled heat sink of FIG. 6.

FIG. 6 shows an isometric view of a water cooled heat sink 116 with LEDs mounted to it. FIG. 6 shows stand-offs 140 that are used to mount the reflective cover over the array of LEDs 108, 110. FIG. 7 shows a top view of the water cooled heat sink 116 and FIG. 8 shows a bottom view of the water cooled heat sink 116.

Figure 8:
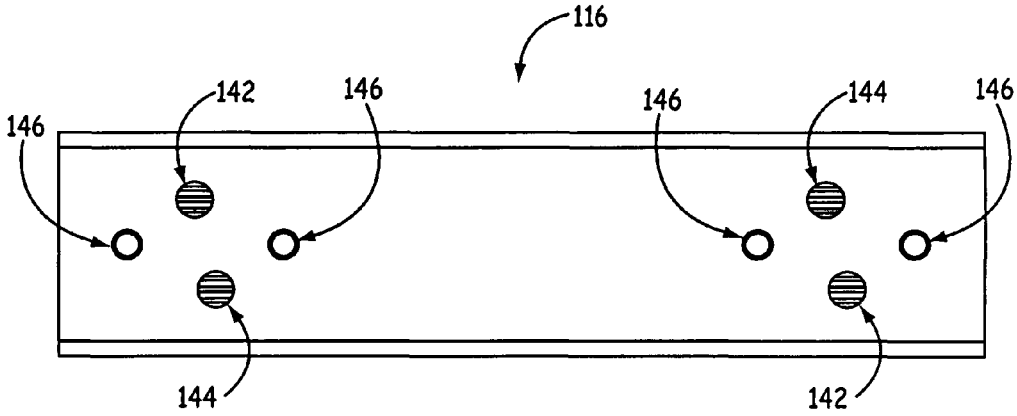
FIG. 8 is a plan view of one embodiment of a suitable heat sink, showing coolant ports thereof.

In FIG. 8 coolant ports 142, 144 can be seen where coolant flows between the distribution manifolds 128 and the water cooled heat sink 116. FIG. 8 also shows bolt holes 146 that are used to fasten the water cooled heat sink 116 to the distribution manifolds 128.

Figure 9:
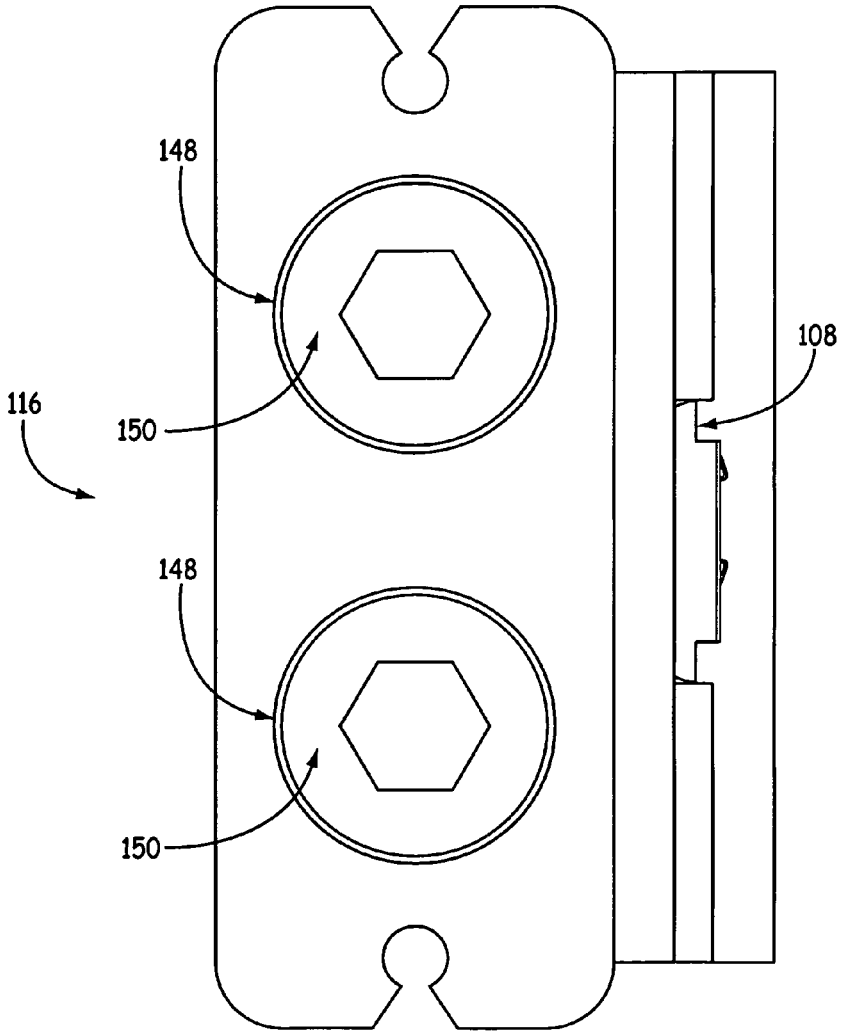
FIG. 9 is an end view of the heat sink of FIG. 6.

FIG. 9 shows an end view of the water cooled heat sink 116 with LEDs 108, 110 mounted to it. It shows water passages 148 that run the length of the water cooled heat sink 116. The water passages are plugged 150 at each end to prevent coolant from flowing anywhere but through the coolant ports 142, 144.

Figure 10:
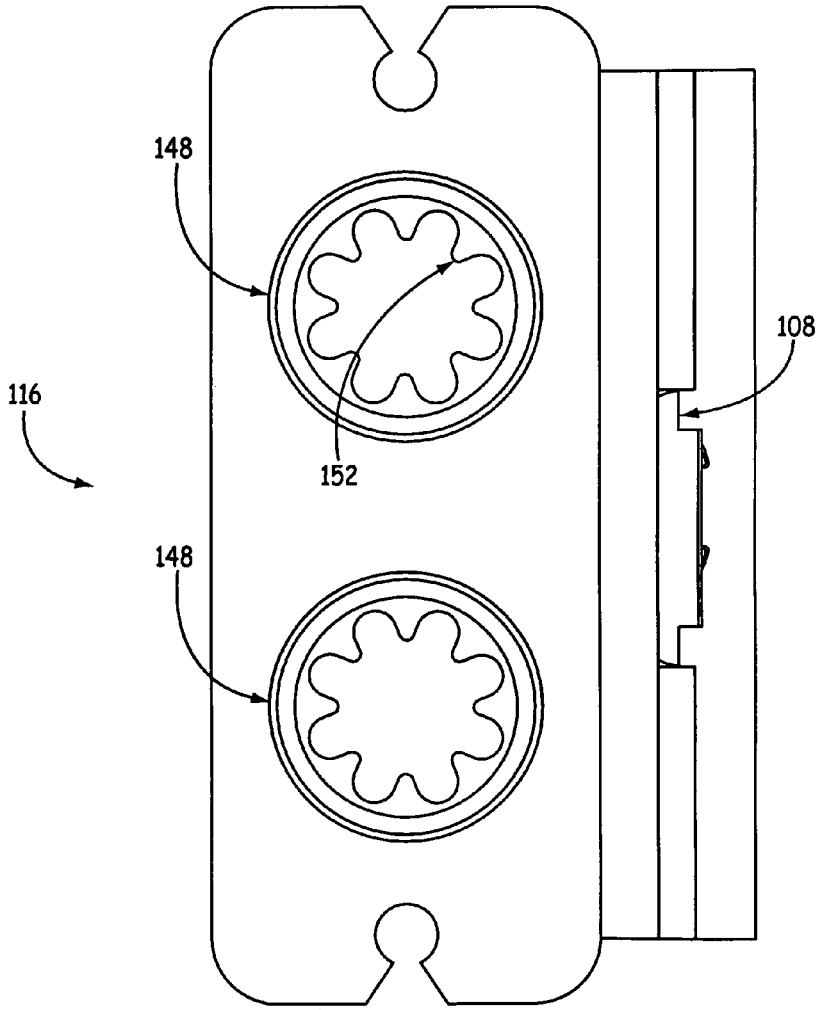
FIG. 10 an end view of the heat sink of FIG. 6 with the plugs removed.

FIG. 10 shows the coolant passages 148 with the plugs 150 removed. The coolant passages 148 may contain fin features 152 that increase the rate of heat transfer into the coolant.

Figure 11:
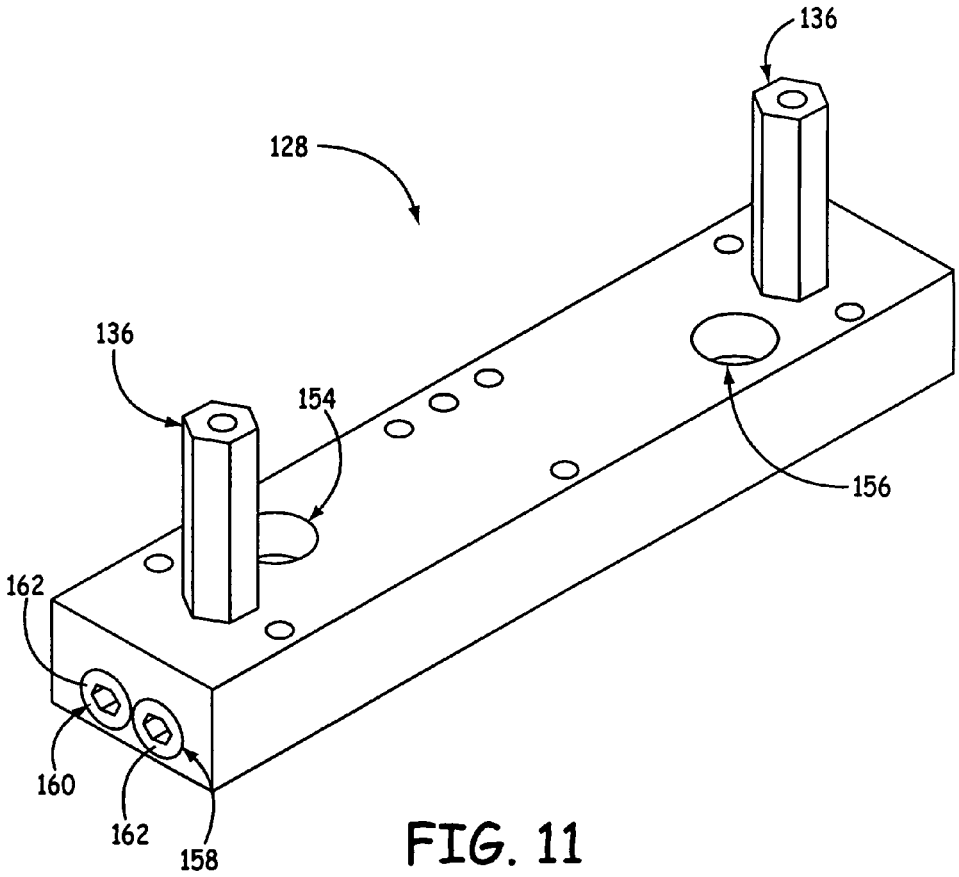
FIG. 11 is an isometric view of a distribution manifold suitable for use in this invention.

FIG. 11 is an isometric view of a distribution manifold 128. FIG. 11 shows the stand-offs 136 that are used to mount the housing 120 to the cooling assembly 138. FIG. 11 shows coolant ports 154, 156 that supply the manifold. The distribution manifold contains to two passages 158, 160 that can act as either the supply or return for the water cooled heat sinks. These passages 158, 160 run the length of the distribution manifold 128 and are plugged 162 at each end.

Figure 12:
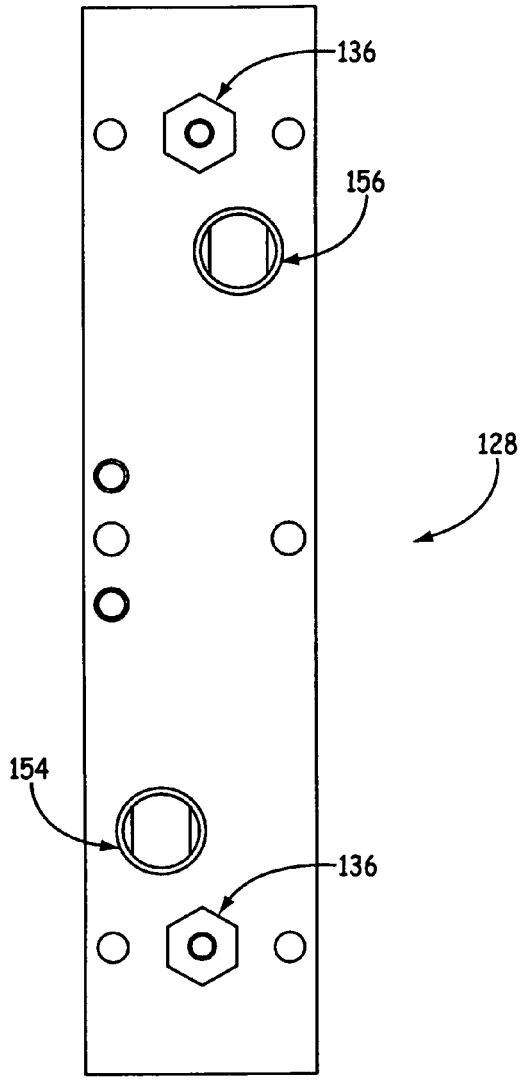
FIG. 12 is a top view of the distribution manifold of FIG. 11.
Figure 13:
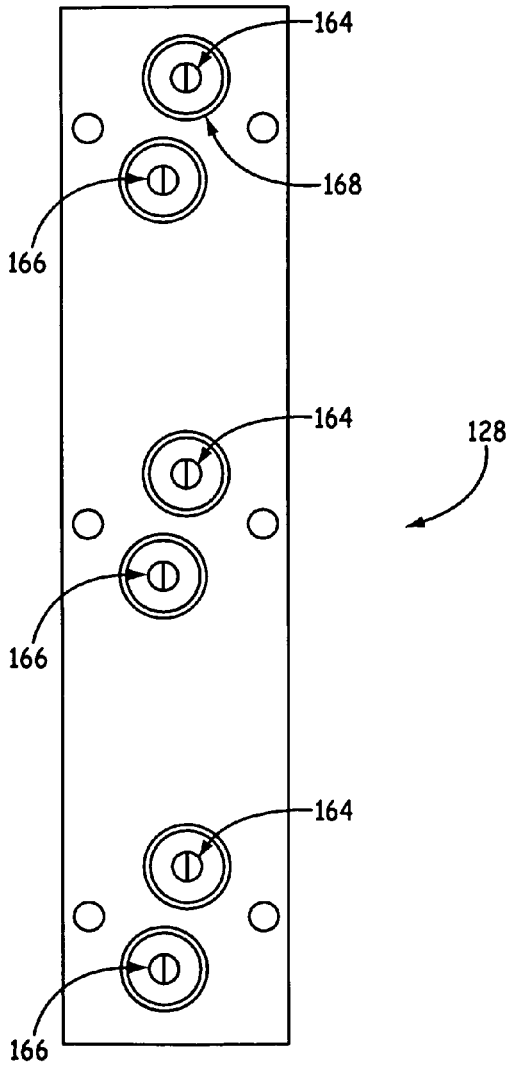
FIG. 13 is a bottom view of the distribution manifold of FIG. 11.

FIG. 12 shows a top view of the distribution manifold 128. FIG. 13 shows a bottom view of the distribution manifold 128. FIG. 13 shows coolant ports 164, 166 that mate with the corresponding coolant ports 142, 144 in the water cooled heat sinks 116. FIG. 13 also shows o-rings 168 that seal the connection between the coolant ports 142, 144 and the coolant ports 164, 166.

The N×M array can be constructed such that the pitch in one direction is the same as the pitch in the other or the two pitches can be different where the pitch is the spacing between LEDs in the array. The array could be constructed such that N equals M where N and M are the number of LEDs in each direction. To achieve uniform irradiation of the substrate, e.g., variation intensity varying no more than about 5%, 2.5%, or 1%, the base of the lamp head must be oriented parallel to the substrate and positioned such that the distance between the base of the lamp head and the substrate is larger than the greatest of the LED pitches within the array. It is also possible to interlace two different LED arrays within one lamp such as is shown in FIG. 3 where LED 108 makes up un array, and LED 110 makes up another array. For example, in FIG. 3, LEDs 108 are positioned in a 3×6 array and LEDs 110 are positioned in a 3×3 array. By way of illustration and not limitation, it has been determined that a 1.2 square meter lamp of this invention has been capable of uniformly illuminating a 1.0 square meter substrate. In this instance, a lamp having an area of positioned LEDs, which is 120% of the substrate surface area emitted such uniform illumination.

To achieve uniform cooling of the LEDs, liquid coolant can be supplied into either of the coolant ports 104, 106. For an example, coolant port 104 is chosen as the supply. Then coolant port 106 will be the return. Coolant flows into coolant port 104 and then into the coolant tee block 126 where it is divided and half of the coolant flows into one distribution manifold 128 and the other half flows into the other distribution manifold 128. The coolant is divided again inside of the distribution manifolds such that one sixth of the coolant flows into each water cooled heat sink 116. The coolant is supplied to each water cooled heat sink 116 such that it flows anti parallel through the fined water passages 148. This provides a uniform average heat sink temperature across the LEDs.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A device for illuminating a substrate with LEDs, comprising:

a first plurality of first LEDs positioned in a first LED array such that said substrate is illuminated substantially uniformly by said first LEDs;

means for providing electrical current to said LEDs; and means for cooling said LEDs, wherein illumination emitted from said first LED array varies less than about 5% in intensity over a surface of said substrate being illuminated.

2. The device of claim 1, wherein illumination emitted from said first LED array varies less than about 2.5% in intensity over a surface of said substrate being illuminated.

3. The device of claim 1, wherein illumination emitted from said first LED array varies less than about 1% in intensity over a surface of said substrate being illuminated.

4. The device of claim 1, wherein said means for cooling said LEDs comprises a water cooled heat sink positioned to cool each LED.

5. The device of claim 1, further comprising a second plurality of second LEDs positioned in a second LED array such that said substrate is illuminated substantially uniformly by said second LEDs.

6. The device of claim 5, wherein illumination emitted from said second LED array varies less than about 5% in intensity over a surface of said substrate being illuminated.

7. The device of claim 5, wherein illumination emitted from said second LED array varies less than about 2.5% in intensity over a surface of said substrate being illuminated.

8. The device of claim 5, wherein illumination emitted from said second LED array varies less than about 1% in intensity over a surface of said substrate being illuminated.

9. A method for uniformly illuminating a substrate, comprising emitting illumination toward said substrate from a first LED array, said first LED array including a first plurality of LEDs positioned such that illumination emitted from said first LED array varies less than about 5% over the surface of said substrate.

10. The method of claim 9, wherein illumination emitted from said first LED array varies less than about 2.5% over the surface of said substrate.

11. The method of claim 9, wherein illumination emitted from said first LED array varies less than about 1% over the surface of said substrate.

12. The method of claim 9, further comprising emitting illumination toward said substrate from a second array, said second LED array including a second plurality of LEDs position such that illumination emitted from said second LED array varies less than about 5% over the surface of said substrate.

13. The method of claim 12, wherein illumination emitted from said second LED array varies less than about 2.5% over the surface of said substrate.

14. The method of claim 9, wherein illumination emitted from said second LED array varies less than about 1% over the surface of said substrate.

15. The method of claim 9, further comprising cooling said first LEDs.

16. The method of claim 15, wherein cooling said first LEDs comprises passing fluid through a heat sink.

* * * * *